US011111749B2

(12) United States Patent
Hussain et al.

(10) Patent No.: US 11,111,749 B2
(45) Date of Patent: Sep. 7, 2021

(54) CORRECTING OFFSETS IN WELLBORE TUBULARS

(71) Applicant: Saudi Arabian Oil Company, Dhahran (SA)

(72) Inventors: Sajid Hussain, Abqaiq (SA); Victor Jose Bustamante Rodriguez, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 155 days.

(21) Appl. No.: 16/412,198

(22) Filed: May 14, 2019

(65) Prior Publication Data

US 2020/0362646 A1 Nov. 19, 2020

(51) Int. Cl.
*E21B 33/03* (2006.01)
*E21B 17/10* (2006.01)

(52) U.S. Cl.
CPC ..... *E21B 33/03* (2013.01); *E21B 17/1078* (2013.01)

(58) Field of Classification Search
CPC ..... E21B 33/03
See application file for complete search history.

(56) References Cited

U.S. PATENT DOCUMENTS

| | | | | |
|---|---|---|---|---|
| 1,548,543 | A | 8/1925 | Moody | |
| 2,173,037 | A * | 9/1939 | Dailey | E21B 33/04 285/123.4 |
| 2,179,814 | A * | 11/1939 | Conaghan | E21B 43/127 277/329 |
| 2,694,450 | A | 11/1954 | Osbun | |
| 2,754,136 | A | 7/1956 | Newton | |
| 4,771,832 | A | 9/1988 | Bridges | |
| 6,318,458 | B1 | 11/2001 | Rainey | |
| 8,307,889 | B2 | 11/2012 | Lewkoski | |
| 2009/0032241 | A1 | 2/2009 | Allen et al. | |
| 2011/0278023 | A1* | 11/2011 | Lewkoski | F16L 7/00 166/387 |
| 2014/0246197 | A1 | 9/2014 | Smith et al. | |
| 2017/0009539 | A1 | 1/2017 | Helvenston et al. | |
| 2018/0100368 | A1* | 4/2018 | Nguyen | E21B 33/03 |

FOREIGN PATENT DOCUMENTS

| | | |
|---|---|---|
| CA | 2462154 | 9/2005 |
| WO | 9517580 | 6/1995 |

OTHER PUBLICATIONS

PCT International Search Report and Written Opinion in International Appln. No. PCT/US2020/032625, dated Jul. 21, 2020, 15 pages.

* cited by examiner

*Primary Examiner* — Robert E Fuller
(74) *Attorney, Agent, or Firm* — Fish & Richardson P.C.

(57) ABSTRACT

A system for positioning an inner tubular within an outer tubular. The outer tubular is inserted in a wellbore and has a first central axis. The inner tubular defines an inner passage of the outer tubular and is inserted in a wellbore. The inner tubular has a second central axis that is offset from and parallel to the first central axis. A flange is attached at an uphole end of the outer tubular and encircles an outer circumference of the inner tubular. The flange has a third central axis that is in-line with the second central axis. A wellhead housing is positioned at an uphole end of the flange and encircles the outer circumference of the inner tubular. A casing hanger is positioned within the wellhead housing and has an interference with the wellhead housing. The casing hanger is frictionally attached to the inner tubular.

18 Claims, 7 Drawing Sheets

CORRECTING OFFSETS IN WELLBORE TUBULARS

TECHNICAL FIELD

This disclosure relates to wellhead installation.

BACKGROUND

Wellbores are drilled for the exploration and recovery of natural resources such as water, oil, or gas. After drilling a wellbore, a completion is installed to convert the wellbore into a production or injection well. In a completed well, one or more wellbore tubulars are cemented in the well to control production and maintain well integrity. Cement is pumped into place in a wellbore to hold the tubulars in place and prevent fluids from moving between the formations.

At the conclusion of the cementing procedures, the upper end of one tubular—usually the inner tubular—is cut off at a selected distance above a wellhead. The wellhead is located at the surface of the well for supporting the upper end of the tubular and contains pressure resulting from drilling operations, production operations, injection operations, or any combination of these operations. The wellhead has a bore that receives the upper end of the inner tubular and includes a casing hanger that supports the inner tubular. This disclosure is applicable to hydrocarbon and water production, as well as injection wells.

SUMMARY

This disclosure describes technologies relating to correcting offsets in wellbore tubulars.

An example implementation of the subject matter described within this disclosure is a system for positioning an inner tubular within an outer tubular positioned within a wellbore with the following features. An outer tubular defines an inner passage and is inserted in a wellbore. The outer tubular has a first central axis. An inner tubular defines an inner passage of the outer tubular. The inner tubular is inserted in a wellbore. The inner tubular has a second central axis that is offset from and parallel to the first central axis. A flange is attached at an uphole end of the outer tubular. The flange encircles an outer circumference of the inner tubular. The flange extends from an outer surface of the inner tubular past an outer surface of the outer tubular. The flange has a third central axis that is in-line with the second central axis. A wellhead housing is positioned at an uphole end of the flange. The wellhead housing encircles the outer circumference of the inner tubular. The flange is positioned between the wellhead housing and the uphole end of the outer tubular. A casing hanger is positioned within the wellhead housing. The casing hanger has an interference with the wellhead housing. The casing hanger is frictionally attached to the inner tubular within the wellhead housing.

Aspects of the example system, which can be combined with the example system alone or in combination, include the following. The casing hanger includes casing slips and a seal assembly installed around the inner tubular.

Aspects of the example system, which can be combined with the example system alone or in combination, include the following. The flange is a long weld neck flange.

Aspects of the example system, which can be combined with the example system alone or in combination, include the following. The flange is made from the same material as that of the wellhead housing.

Aspects of the example system, which can be combined with the example system alone or in combination, include the following. The flange is welded to the outer casing of the outer tubular.

Aspects of the example system, which can be combined with the example system alone or in combination, include the following. The flange is welded to the wellhead.

Certain aspects of the subject matter described here can be implemented as a method. A flange is positioned around an inner tubular and atop an uphole end of an outer tubular. The outer tubular encircles the inner tubular. The inner tubular has a fixed offset from the outer tubular. A wellhead housing is positioned atop the flange. A casing hanger is inserted into the wellhead housing. The casing hanger encircles the inner tubular. The casing hanger includes casing slips and a seal assembly. The flange is welded to an outer casing of the outer tubular. The wellhead housing is welded to the flange. The seal assembly is energized.

Aspects of the example method, which can be combined with the example method alone or in combination, include the following. The flange is welded to the outer tubular prior to being welded to the wellhead housing.

Aspects of the example method, which can be combined with the example method alone or in combination, include the following. The inner tubular is cut to a first specified height above the wellhead housing. The blow out preventer is removed. The outer tubular is cut to a second specified height lower than the first specified height.

Aspects of the example method, which can be combined with the example method alone or in combination, include the following. The inner tubular is cut before the outer tubular is cut.

Aspects of the example method, which can be combined with the example method alone or in combination, include the following. The wellhead housing is positioned atop the flange prior to the casing hanger being positioned within the wellhead housing.

Aspects of the example method, which can be combined with the example method alone or in combination, include the following. The fixed off-set between the inner and outer tubulars is fixed by cement.

Aspects of the example method, which can be combined with the example method alone or in combination, include the following. The casing slips include a manual casing slip.

Aspects of the example method, which can be combined with the example method alone or in combination, include the following. The seal assembly is energized after the casing hanger is positioned.

Certain aspects of the subject matter described here can be implemented as a method. A flange is supporting a wellhead housing to an inner tubular. The inner tubular is encircled by an outer tubular. The outer tubular has a first central axis. The inner tubular has a second central axis off-set and parallel to the first central axis. The flange has a third central axis that is in-line with the second central axis. The wellhead housing has a fourth central axis that is in-line with the second central axis.

Aspects of the example method, which can be combined with the example method alone or in combination, include the following. The flange is positioned between the outer tubular and the wellhead housing.

Aspects of the example method, which can be combined with the example method alone or in combination, include the following. The flange is welded to the outer casing of the outer tubular.

Aspects of the example method, which can be combined with the example method alone or in combination, include the following. The flange is welded to the wellhead.

Aspects of the example method, which can be combined with the example method alone or in combination, include the following. A casing hanger is inserted within the wellhead housing. The casing hanger includes casing slips and a seal assembly. The inner tubular is supported, at least partially, by the casing hanger. The casing hanger is positioned within the wellhead housing. The casing hanger encircles the inner tubular. The casing hanger has a fifth central axis that is in line with the second central axis.

Aspects of the example method, which can be combined with the example method alone or in combination, include the following. The off-set between the inner and outer tubulars is fixed by cement.

Particular implementations of the subject matter described in this disclosure can be implemented so as to realize one or more of the following advantages. The method described in this disclosure uses commonly used materials. For example, the offset wellhead housing can be the same as the corrected wellhead housing. The long weld neck flange is readily available and does not require special materials or construction. Unlike other offset correction methods, the casing slips need no additional seal or locking mechanism. Further, providing a solution to the eccentricity between the wellbore tubulars without changing positions of the cemented tubulars retains the well integrity. Employing the described solution in this disclosure also minimizes the amount of work performed by labor and, thus, reducing the likelihood of human error. For example, mistakes while attempting to correct casing misalignment using traditional methods can lead to well integrity issues, which may ultimately lead to plugging and abandonment of the well.

The details of one or more implementations of the subject matter described in this disclosure are set forth in the accompanying drawings and the description. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This disclosure relates to the installation of a wellhead when a cemented inner tubular is offset from and parallel to a cemented outer tubular. As a result, the central axis of the inner tubular is not in-line with the axis of a wellhead housing and, thus, prevents the installation of the casing hanger. Because the inner tubular is cemented in the well, moving it to correct the axial misalignment is difficult. The axial misalignment creates an interference between the casing hanger and the wellhead housing, preventing the casing hanger from being properly installed. This prevents the wellhead from being completed without intervention.

To accommodate for the offset, the wellhead installation stack (blowout preventer, wellhead housing, wellhead support plate, etc.) is first removed. Next, a flange, such as a long weld neck flange, is installed around the offset inner tubular so that the flange is axially aligned with the offset inner tubular. Alternatively, a circular type plate without an integrated long neck can be used in lieu of the long weld neck flange. In some implementations, the flange includes a circular hollow plate that has no bolt holes and no gasket recess. The circular plate can be welded and integrated with a long neck mandrel. The flange includes a machined hole that can have slightly greater inside diameter than an outside diameter of the offset inner tubular. In some implementations, an outer diameter of the flange is slightly greater than an outside diameter of the outer tubular. The remaining stack (wellhead housing, casing hanger, etc.) is installed on top of the flange. The flange, which can be made from the same material as the corrected wellhead housing, is then welded to the outer tubular and the corrected wellhead housing. The installation of the flange around the inner tubular aligns the central axis of the inner tubular to the central axis of the wellhead installation stack.

The design described here provides a solution to the eccentricity issue without the need for extensive wellhead remedial work. As this disclosure explains, this solution is significant because it reduces the time that is usually required to correct such an offset. Traditional methods to solve the eccentricity issue revolves around drilling out the wellhead or trying to pull the two offset tubulars towards each other by force risking the integrity of the cement job. This causes enormous stress on the wellhead structure, and increases wear and tear to the tools and components used.

Figure 1:
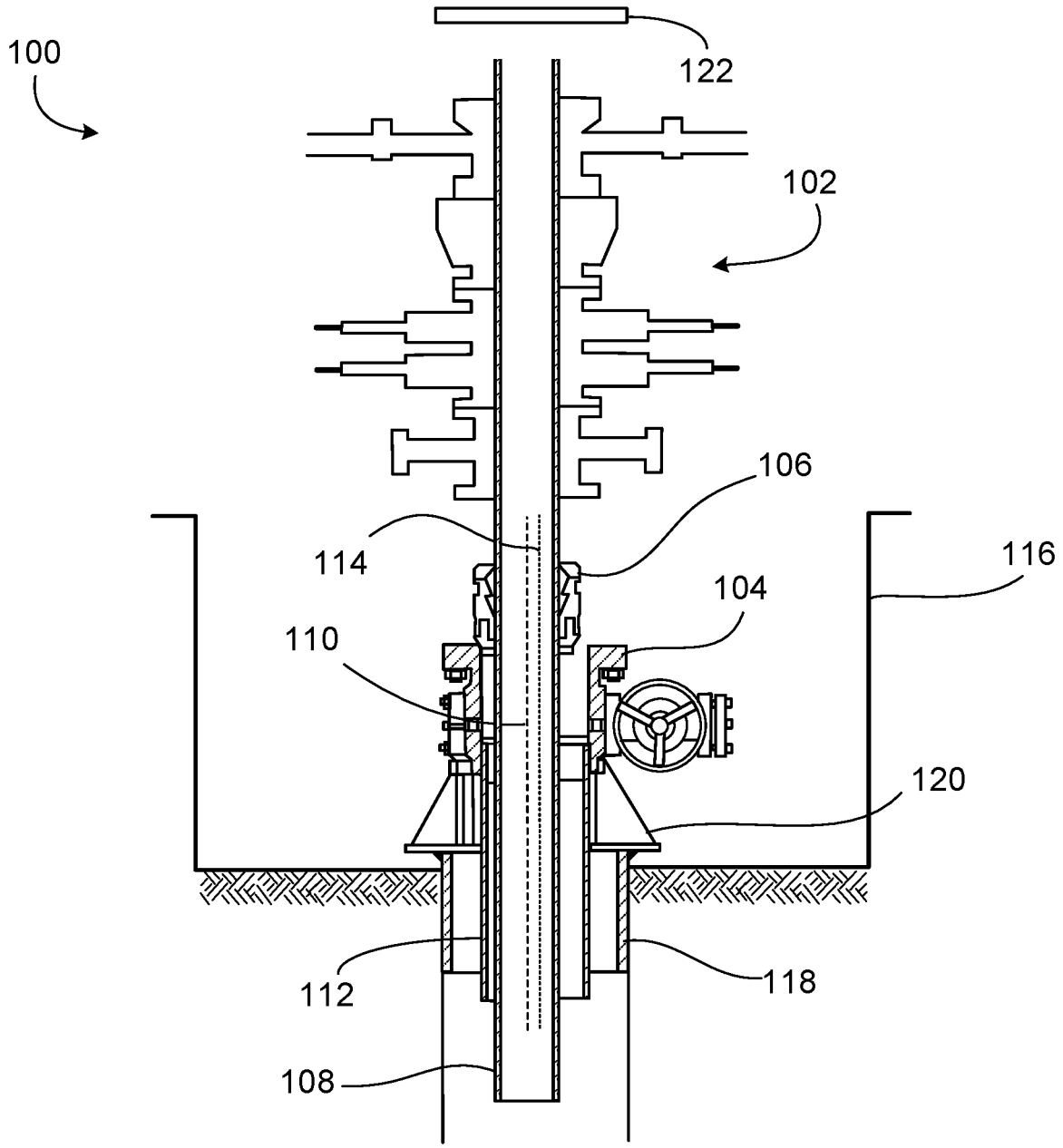
FIG. 1 is a side cross-sectional diagram of an example wellhead with an axial offset that can be used with aspects of this disclosure.

FIG. 1 shows an example wellhead 100 under a rotary table 122 and within a cellar 116. The rotary table 122 is the revolving section of a drill floor that provides power to turn the drill bit assembly. The cellar 116 in a land rig is a dug-out pit, usually lined with cement that serves as a cavity in which a wellhead is located and as a work space around the wellbore for workers. The example wellhead 100 has an axial misalignment between a wellhead housing 104, a liner 118, and an outer tubular 112, on one hand, and an inner tubular 108, on the other. A central axis 114 of the outer tubular 112 is offset from and parallel to a central axis 110 of the inner tubular 108. A casing hanger 106 is frictionally attached to the inner tubular 108 positioned within the wellhead housing 104. Because the inner tubular 108 is cemented in the well, overcoming the eccentricity between the inner tubular 108 and wellhead housing 104 in order to facilitate the installation of the wellhead installation stack can be difficult. While described in the context of a land-based drilling rig and well installation, details of the subject matter described within this disclosure are equally applicable to offshore well-sites.

Attempts to overcome this challenge usually revolve around performing extensive wellhead remedial work or even suspension and abandonment of the well. Wellhead remedial work using traditional methods to correct the offset can include drilling out the wellhead and cemented tubulars. It might require changing tools and components. This effort may typically take up to days or weeks depending on the availability of needed tools and materials. In contrast, remedial work according to a method of this disclosure (described later) may take less than a day.

Figure 2:
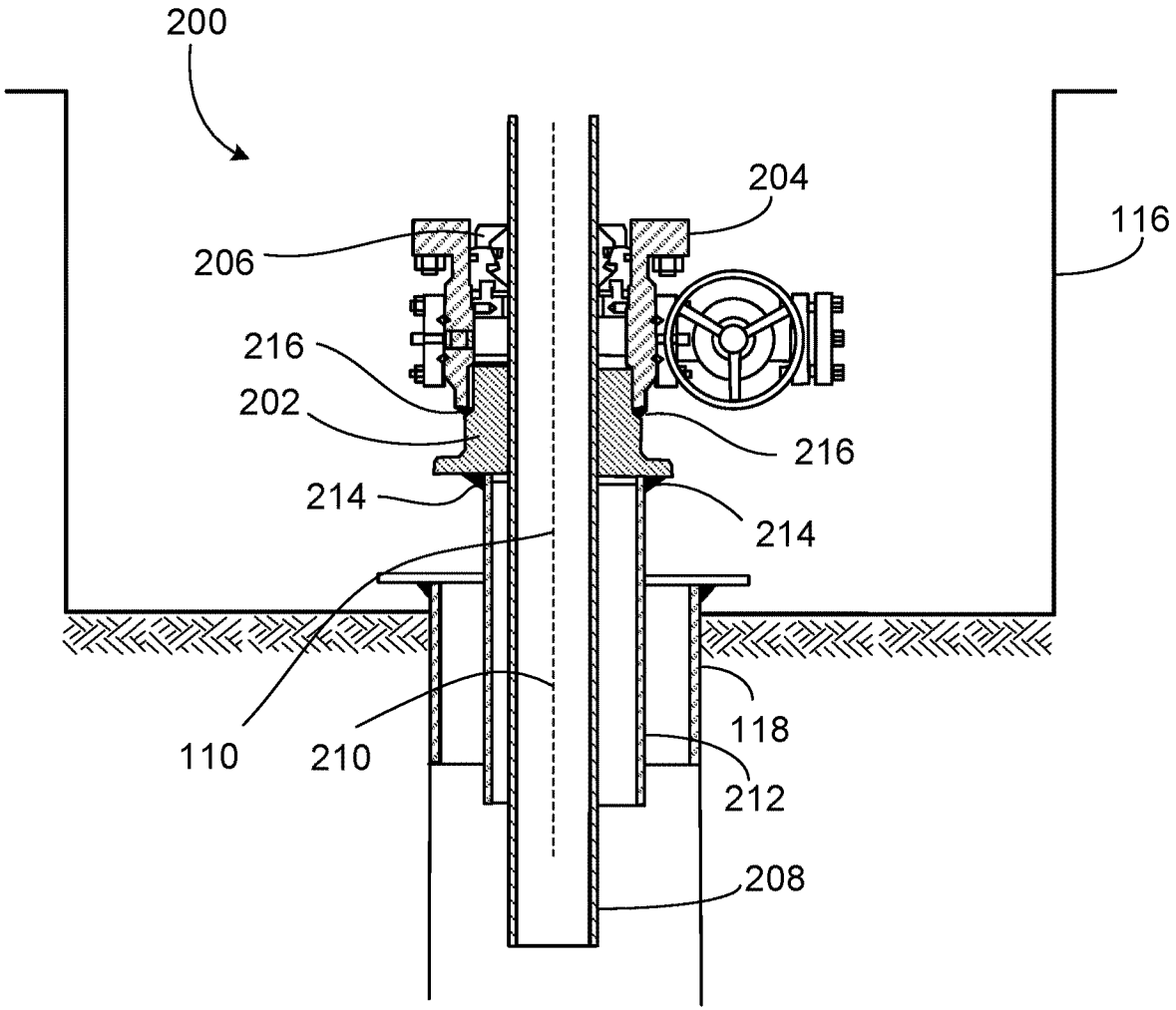
FIG. 2 is a side cross-sectional diagram of an example wellhead with a corrected axial offset using an example offset correction method of this disclosure.

Problems such as those described with respect to FIG. 1 might occur in the installation of any wellhead. Thus, a solution that can be applied to offsets in wellbore tubulars is illustrated in FIG. 2. Before the solution can be implemented, some steps, which are described throughout this disclosure, can be done to prepare the wellbore tubulars to receive and be welded to the flange and wellhead housing. Throughout this disclosure, a "flange" can include any circular hollow plate with integrated neck. The flange itself can be custom built for the desired application. In some implementations, a longneck flange can be used. After removing the wellhead installation stack, the inner tubular 108 and outer tubular 112 are to be cut at specified lengths and further preparations are to be done to them to be welded to the other parts of the corrected wellhead system as shown in FIG. 2. For example, the outer tubular 112 is cut immediately below the removed wellhead housing 104. For example, the inner tubular 108 is cut at a certain length so as to leave a stub for the re-installation of the corrected wellhead system. The resulting tubulars illustrated in FIG. 2 are a corrected inner tubular 208 and corrected outer tubular 212.

The solution illustrated in FIG. 2 includes a long weld neck flange 202 on top of a corrected outer tubular 212 and around a corrected inner tubular 208. The long weld neck flange 202 aligns the central axis 110 of the corrected inner tubular 208 to a central axis 210 of a corrected wellhead housing 204 and a central axis 210 of a corrected casing hanger 206. This is done by creating enough clearance between the corrected inner tubular 208 and the corrected wellhead housing 204 in order to slide the corrected casing hanger 206 into the corrected wellhead housing 204. The casing hanger 206 is then seated on a shoulder within the wellhead housing 204 creating an interference that retains and supports the casing hanger 206. As a result, the corrected wellhead housing 204 is now offset from and parallel to the corrected outer tubular 212, but in-line with the corrected inner tubular 208. The flange 202 is made of a material strong enough to bear the wellhead installation stack. In some implementations, the flange 202 can be constructed from the same material as the corrected wellhead housing 204, the corrected outer tubular 212, or both. Having similar materials reduces welding difficulties and reduces the risk of galvanic corrosion.

The corrected outer tubular 212 is connected to the flange 202 by a first weld 214. The corrected inner tubular 208 is positioned within the corrected outer tubular 212. In some implementations, the corrected inner tubular 208 and corrected outer tubular 212 can be steel pipes configured to fit and be lowered into a wellbore. Wellbore tubulars are then cemented in place to prevent formation fluids from penetrating the wellbore or to protect fresh water aquifers, among other reasons. Long wellbore tubulars may require higher strength materials on their upper portion to withstand the tubulars' load. Lower portions of the tubulars can have greater wall thicknesses to withstand extreme pressures, especially in deep wellbores.

The corrected wellhead housing 204 is connected to the long weld neck flange 202 by a second weld 216. In some implementations, the corrected wellhead housing 204 can be threaded to the long weld neck flange 202 or the corrected outer tubular 212. The corrected wellhead housing 204 can have a flanged or clamped connection to connect to the blowout preventer (BOP) stack 102. The corrected wellhead housing 204 acts as an adapter between the flange 202 and the BOP stack 102. Because the central axis 210 of the long weld neck flange 202 is now aligned with the central axis 110 of the corrected inner tubular 208, the corrected wellhead housing 204 can be positioned around the corrected inner tubular 208.

The corrected casing hanger 206 slides within an annulus defined by an inner surface of the corrected wellhead housing 204 and an outer surface of the inner tubular 208. The annulus has sufficient clearance in part because of the alignment between the central axis 110 of the corrected inner tubular 208 and the central axis 210 of the wellhead installation stack. The corrected casing hanger 206 is made of a material strong enough to support and transfer the weight of the corrected inner tubular 208 to the corrected wellhead housing 204. The corrected casing hanger 206 includes casing slips that seal off the annulus between the corrected inner tubular 208 and the corrected wellhead housing 204 by a seal assembly. The casing slips are engaged with the corrected inner tubular 208 by frictional attachment to ensure better sealing and weight transfer. In some implementations, the casing slips include manual casing slips. In some implementations, the seal assembly includes elastomer seals.

Figure 3:
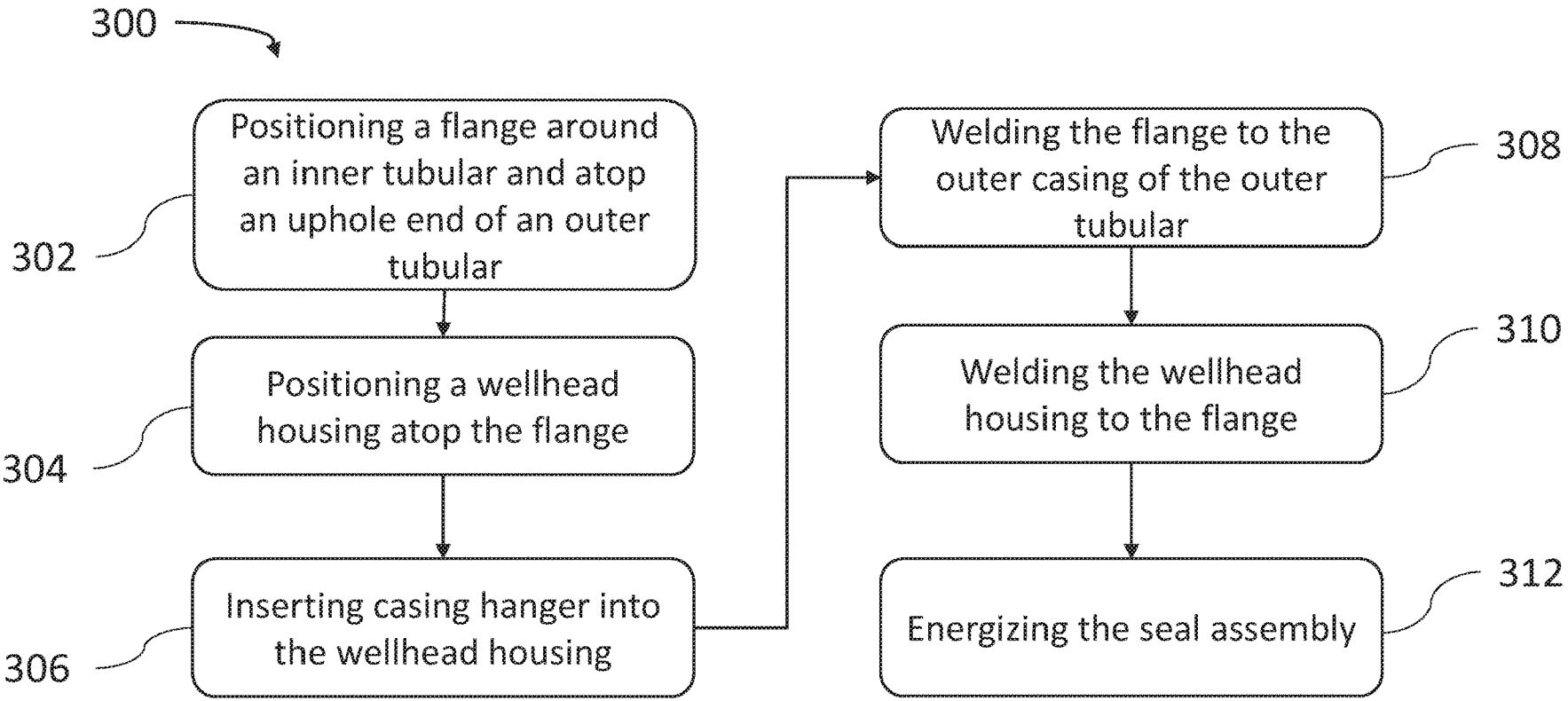
FIG. 3 is a flowchart of an example method that can be used with aspects of this disclosure.
Figure 4A:
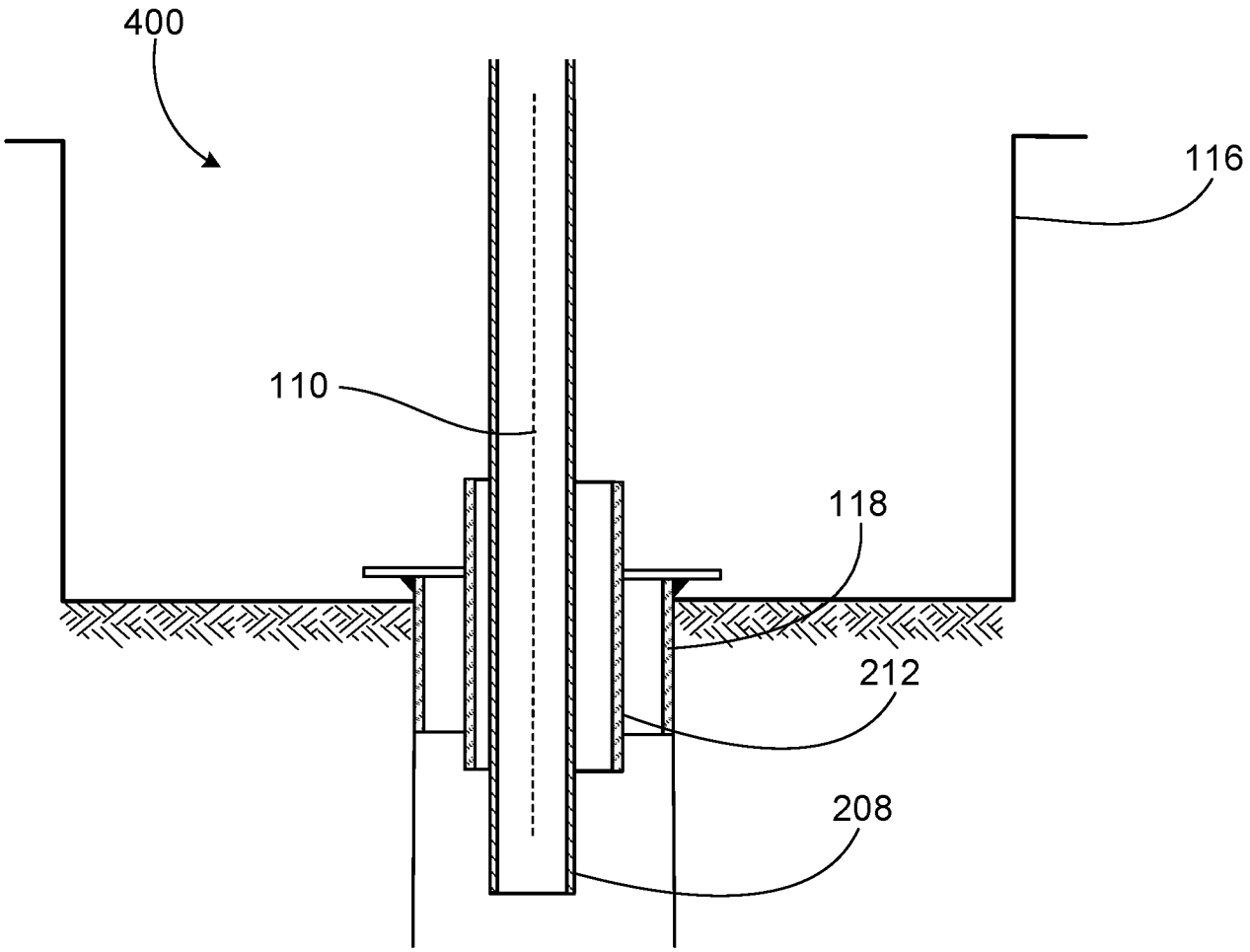
FIGS. 4A-4D are cross-sectional diagrams showing steps of the installation of the example wellhead offset correction method described within this disclosure.

FIG. 3 shows a flowchart of a method 300 that can be implemented to install a wellhead atop an offset inner tubular 108 that is cemented to the wellbore, such as the corrected wellhead system 200. Details of the method 300 are described in the context of FIGS. 4A-4D. Referring back to FIG. 1, which describes the eccentricity problem between the inner tubular 108 and the wellhead housing 104, and FIG. 4A, which shows the example incomplete wellhead 400.

Figure 4B:
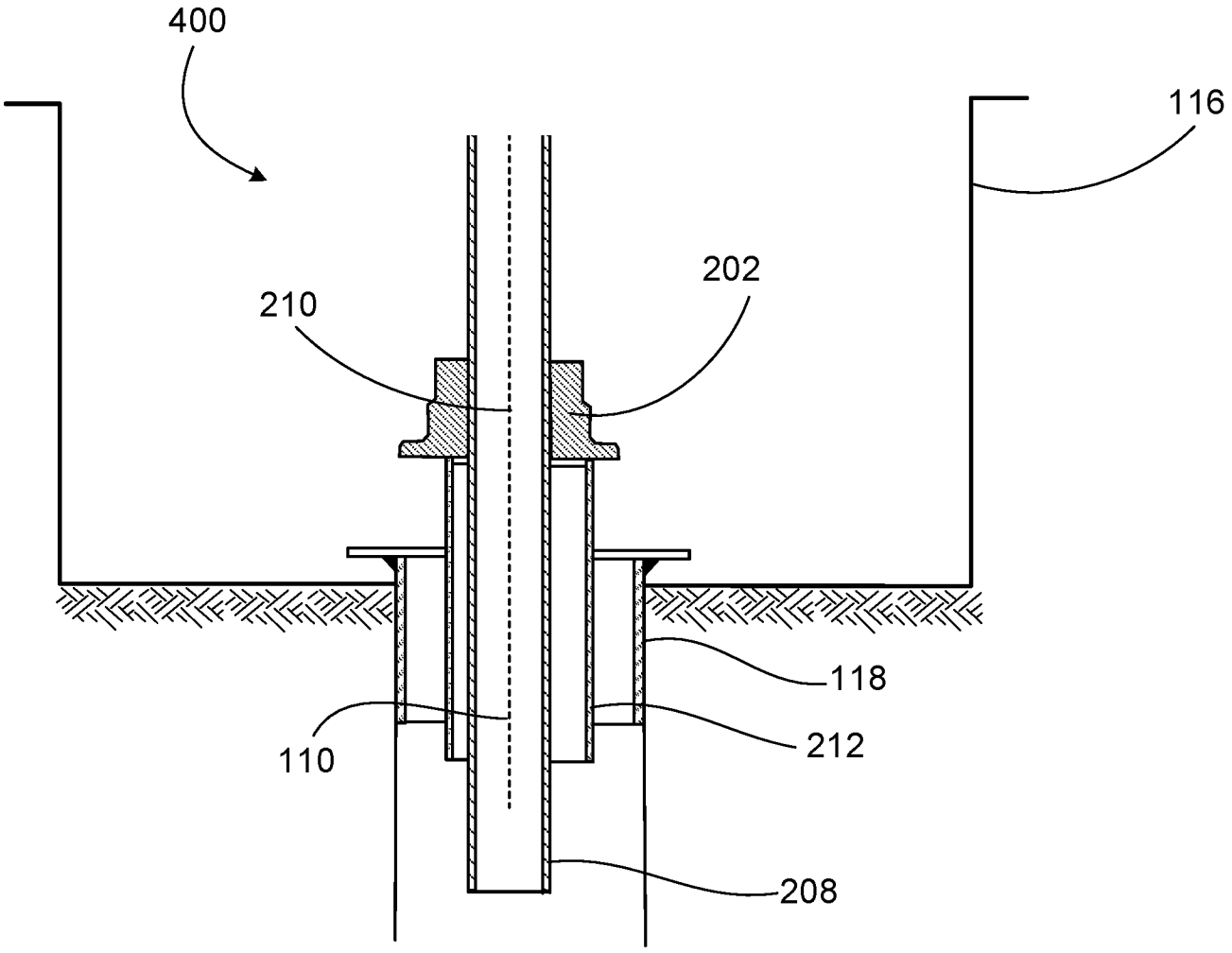
Figure 4C:
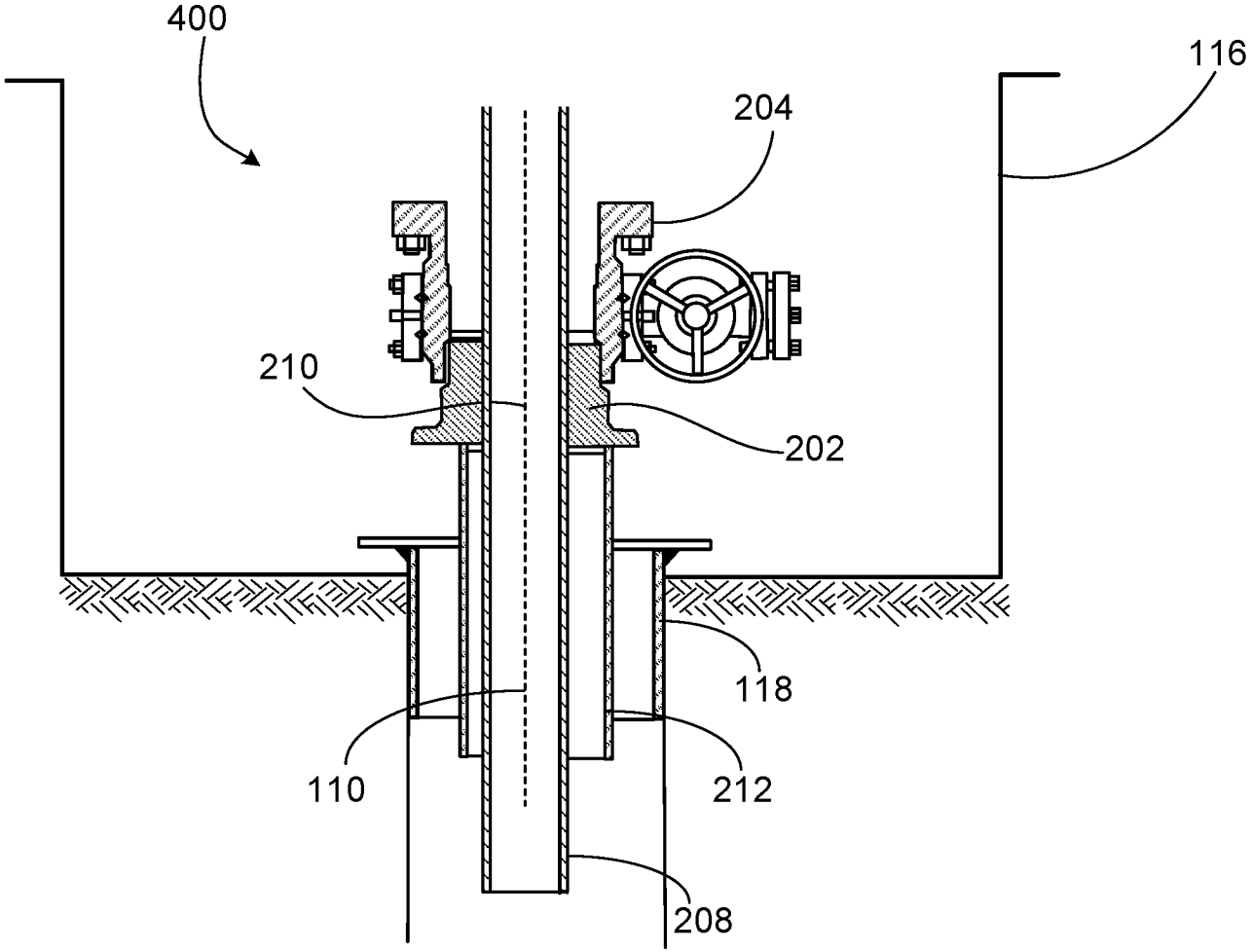

Referring back to FIG. 3, at 302, the long weld neck flange 202 is positioned around the corrected inner tubular 208 and on top of the corrected outer tubular 212, which aligns the central axis 110 of the corrected inner tubular 208 with the central axis 210 of the wellhead installation stack, as shown in FIG. 4B. Thus, the downhole end of the flange 202 sits at an uphole end of the corrected outer tubular 212. At 304, the corrected wellhead housing 204 is installed on top of the long weld neck flange 202 and around the corrected inner tubular 208, as illustrated by FIG. 4C. The long weld neck flange 202 can have the same materials as the corrected wellhead housing 204 and is capable of bearing the same structure as the wellhead housing 104. Due to the installation of the long weld neck flange 202, the central axis 110 is now aligned with the central axis 210 of the corrected wellhead housing 204.

Figure 4D:
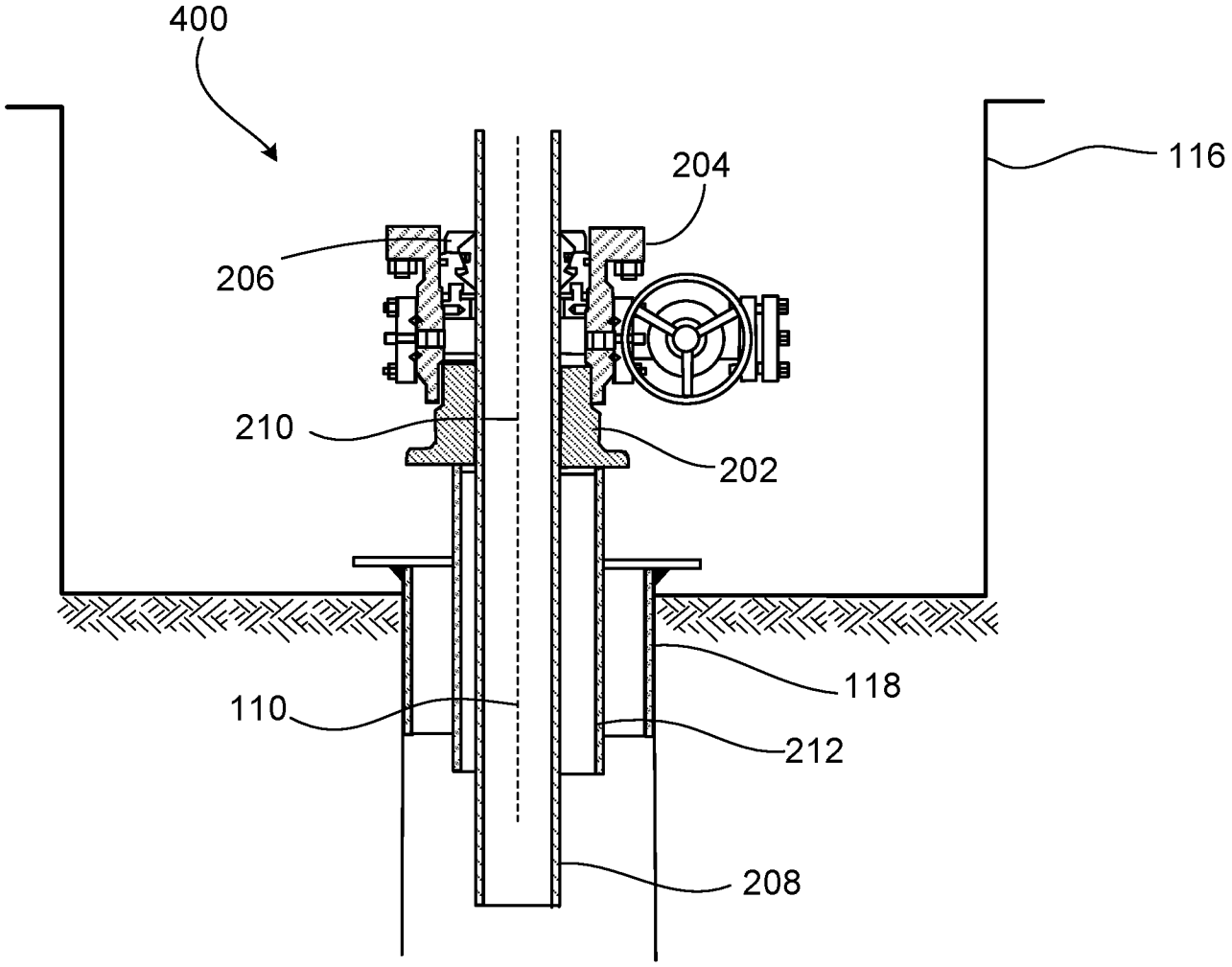

As shown in FIG. 4D and FIG. 3, at 306, the corrected casing hanger 206 is inserted within the corrected wellhead housing 204 and around the corrected inner tubular 208. The corrected casing hanger 206 is installed such that it is seated on a shoulder within the corrected wellhead housing 204. Such a shoulder provides an interference that supports the casing hanger 206. The corrected casing hanger 206 is frictionally attached to the corrected inner tubular 208 within the corrected wellhead housing 204. The central axis 110 of the corrected inner tubular 208 is now aligned with the central axis 210 of the corrected casing hanger 206. As such, the corrected casing hanger 206 can provide support to the corrected inner tubular 208. The corrected casing hanger 206 includes casing slips and a seal assembly. In some implementations, the casing slips include manual casing slips. At 308, the downhole end of the flange 202 is welded to the outer casing of the corrected outer tubular 212. Alternative joining methods such as electrofusion, bolted flange connections, V-Band clamps, or other mechanical connections can be used.

At 310, the long weld neck flange 202 is then welded to the corrected wellhead housing 204. Alternative joining methods such as electrofusion, bolted flange connections, V-Band clamps, or other mechanical connections can be used. At 312, the seal assembly is energized to seal off the annulus between the corrected inner tubular 208 and the corrected wellhead housing 204. The seal assembly is installed by engaging with the outer casing of the corrected inner tubular 208. As the seal lips travel down, they are forced against the tubular 208, which applies a load on the seal assembly that effectively seals the annulus between the tubular 208 and the corrected wellhead housing 204. The seal is energized when this installation creates a pressure barrier zone to isolate the annulus from the wellbore. In some implementations, the seal assembly includes elastomer seals.

In some implementations, preparation steps are done prior to applying the example method 300. Such preparation steps can include removing the BOP stack 102. The inner tubular 108 can be cut at a specified length above the wellhead housing 104. This is done in order to leave a sufficient stub for the corrected wellhead housing 204 to encircle the corrected inner tubular 208 and for the BOP stack 102 to be re-installed on top of the corrected inner tubular 208. The outer tubular 112 can be cut at a specified length below the wellhead housing 104 in order to accommodate the long weld neck flange 202 of the example offset-correction method 300. Finally, the wellhead housing 104 and wellhead support plate 120 can be removed for the long weld neck flange 202 to be installed in order to align the central axis 110 of the corrected inner tubular 208 and the central axis 210 of the wellhead installation stack.

In some implementations, the order of when the long weld neck flange 202 is welded to the corrected wellhead housing 204 and the outer casing of the corrected outer tubular 212 can be different. For example, the flange 202 can be welded to the corrected wellhead housing 204 prior to the flange 202 being welded to the corrected outer tubular 212. Alternatively, the flange 202 can be welded to the corrected wellhead housing 204 and welded to the corrected outer tubular 212 at the same time. The welding procedures can be done while assembling the components according to the method 300, or the welding can be done after completing the assembly and putting all components together. In some implementations, additional sub-steps can be included. For example, a final cut is performed on the corrected inner tubular 208 and the voids of the seal assembly are tested. The BOP is then installed, and the system can be operated in normal drilling and completion operations. While aspects of this disclosure are described in the context of a land-based well system, such aspects can be applied to an off-shore well system without departing from this disclosure.

While this disclosure contains many specific implementation details, these should not be construed as limitations on the scope of any inventions or of what may be claimed, but rather as descriptions of features specific to particular implementations of particular inventions. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations previously described should not be understood as requiring such separation in all implementations, and it should be understood that the described components and systems can generally be integrated together in a single product or packaged into multiple products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

The invention claimed is:

1. A system for positioning an inner tubular within an outer tubular positioned within a wellbore, the system comprising:

an outer tubular defining an inner passage inserted in a wellbore, the outer tubular having a first central axis;

an inner tubular defining an inner passage of the outer tubular, the inner tubular inserted in a wellbore, the inner tubular having a second central axis that is offset from and parallel to the first central axis;

a flange attached at an uphole end of the outer tubular, the flange encircling an outer circumference of the inner tubular, wherein the flange extends from an outer surface of the inner tubular past an outer surface of the outer tubular, the flange having a third central axis that is in-line with the second central axis;

a wellhead housing, the wellhead housing positioned at an uphole end of the flange and the wellhead housing encircling the outer circumference of the inner tubular, the flange positioned between the wellhead housing and the uphole end of the outer tubular; and a casing hanger positioned within the wellhead housing, the casing hanger frictionally attached to the inner tubular within the wellhead housing.

2. The system of claim 1, wherein the casing hanger comprising casing slips and a seal assembly installed around the inner tubular.

3. The system of claim 1, wherein the flange is a long weld neck flange.

4. The system of claim 1, wherein the flange is made from the same material as that of the wellhead housing.

5. The system of claim 1, wherein the flange is welded to the outer surface of the outer tubular.

6. The system of claim 1, wherein the flange is welded to the wellhead housing.

7. A method comprising:

providing a blow out preventer;

providing a wellhead housing;

providing an inner tubular and an outer tubular that encircles the inner tubular, the inner tubular having a fixed offset from the outer tubular;

removing the blow out preventer;

cutting the inner tubular to a first specified height above the wellhead housing;

cutting an outer tubular to a second specified height lower than the first specified height;

positioning a flange around the inner tubular and atop an uphole end of the outer tubular;

positioning a corrected wellhead housing atop the flange;

inserting a casing hanger into the corrected wellhead housing, the casing hanger encircling the inner tubular, the casing hanger comprising casing slips and a seal assembly;

welding the flange to an outer surface of the outer tubular;

welding the corrected wellhead housing to the flange; and energizing the seal assembly.

8. The method of claim 7 wherein the flange is welded to the outer tubular prior to being welded to the corrected wellhead housing.

9. The method of claim 7, wherein cutting the inner tubular occurs prior to the cutting the outer tubular.

10. The method of claim 7, wherein the corrected wellhead housing is positioned atop the flange prior to the casing hanger being positioned within the corrected wellhead housing.

11. The method of claim 7, wherein the fixed offset between the inner and outer tubulars is fixed by cement.

12. The method of claim 7, wherein the casing slips comprise a manual casing slip.

13. The method of claim 12, wherein the seal assembly is energized after positioning the casing hanger.

14. A method comprising:

providing a blow out preventer;

providing a wellhead housing;

providing an inner tubular encircled by an outer tubular, the outer tubular having a first central axis, the inner tubular having a second central axis offset and parallel to the first central axis;

removing the blow out preventer;

cutting the inner tubular to a first specified height above the wellhead housing;

cutting the outer tubular to a second specified height lower than the first specified height;

attaching, by a flange, a corrected wellhead housing to the inner tubular, the flange having a third central axis that is in-line with the second central axis, the corrected wellhead housing having a fourth central axis that is in-line with the second central axis;

inserting a casing hanger within the corrected wellhead housing, the casing hanger comprising casing slips and a seal assembly; and supporting the inner tubular, at least partially, by the casing hanger positioned within the corrected wellhead housing and encircling the inner tubular, the casing hanger having a fifth central axis that is in line with the second central axis.

15. The method of claim 14, wherein the flange is positioned between the outer tubular and the corrected wellhead housing.

16. The method of claim 14, wherein the flange is welded to the outer tubular.

17. The method of claim 14, wherein the flange is welded to the corrected wellhead housing.

18. The method of claim 14, wherein the offset between the inner and outer tubulars is fixed by cement.

* * * * *